US008876988B2

(12) United States Patent
Chida et al.

(10) Patent No.: US 8,876,988 B2
(45) Date of Patent: Nov. 4, 2014

(54) STEEL FOR NITRIDING AND NITRIDED PART

(75) Inventors: Tetsushi Chida, Tokyo (JP); Manabu Kubota, Tokyo (JP); Toshimi Tarui, Tokyo (JP); Daisuke Hirakami, Tokyo (JP); Masayuki Hashimura, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 13/702,285

(22) PCT Filed: Nov. 17, 2011

(86) PCT No.: PCT/JP2011/076513

§ 371 (c)(1),
(2), (4) Date: Dec. 5, 2012

(87) PCT Pub. No.: WO2012/067181

PCT Pub. Date: May 24, 2012

(65) Prior Publication Data

US 2013/0087250 A1 Apr. 11, 2013

(30) Foreign Application Priority Data

Nov. 17, 2010 (JP) ..... 2010-257183
Nov. 17, 2010 (JP) ..... 2010-257210

(51) Int. Cl.

| | |
|---|---|
| ***C22C 38/38*** | (2006.01) |
| ***C22C 38/24*** | (2006.01) |
| ***C21D 1/06*** | (2006.01) |
| ***C22C 38/32*** | (2006.01) |

(52) U.S. Cl.
USPC ..... 148/330; 148/318; 148/333; 148/334

(58) Field of Classification Search
USPC ..... 148/318, 333, 334, 330
See application file for complete search history.

(56) References Cited

U.S. PATENT DOCUMENTS 6,319,338 B1 * 11/2001 Kawano et al. ..... 148/328
2007/0119519 A1 5/2007 Okonogi et al.

FOREIGN PATENT DOCUMENTS

| | | | |
|---|---|---|---|
| JP | 58-71357 | A | 4/1983 |
| JP | 62-205245 | A | 9/1987 |
| JP | 4-83849 | A | 3/1992 |
| JP | 5-65592 | A | 3/1993 |
| JP | 7-157842 | A | 6/1995 |

(Continued)

OTHER PUBLICATIONS

English Abstract and English Machine Translation of Fukuzumi et al. (JP 10-298703) (1998).*

(Continued)

*Primary Examiner* — Jessee Roe
(74) *Attorney, Agent, or Firm* — Birch, Stewart, Kolasch & Birch, LLP

(57) ABSTRACT

The present invention provides a steel for nitriding with a composition including, by mass %: C: 0.10% to 0.20%; Si: 0.01% to 0.7%; Mn: 0.2% to 2.0%; Cr: 0.2% to 2.5%; Al: 0.01% to less than 0.19%; V: over 0.2% to 1.0%; Mo: 0% to 0.54%; N: 0.001% to 0.01%; P limited to not more than 0.05%; S limited to not less than 0.2%; and a balance including Fe and inevitable impurities, the composition satisfying $2 \leq [V]/[C] \leq 10$, where [V] is an amount of V by mass % and [C] is an amount of C by mass %, in which the steel for nitriding has a microstructure containing bainite of 50% or more in terms of an area percentage.

14 Claims, 6 Drawing Sheets

(56) References Cited

FOREIGN PATENT DOCUMENTS

| | | | | | |
|---|---|---|---|---|---|
| JP | 07-286257 | A | | 10/1995 | |
| JP | 9-256045 | A | | 9/1997 | |
| JP | 9-279295 | A | | 10/1997 | |
| JP | 10-298703 | | * | 11/1998 | ..... C22C 38/00 |
| JP | 2006-022350 | | * | 1/2006 | ..... C22C 38/00 |
| JP | 2006-22350 | A | | 1/2006 | |
| JP | 2006-233237 | A | | 9/2006 | |
| JP | 2006-249504 | A | | 9/2006 | |
| JP | 2006-291310 | A | | 10/2006 | |
| JP | 2007-146232 | A | | 6/2007 | |
| JP | 2009-191322 | | * | 8/2009 | ..... C22C 38/00 |
| JP | 2010-163671 | A | | 7/2010 | |

OTHER PUBLICATIONS

English Abstract and English Machine Translation of Fujimatsu, et al. (JP 2009-191322) (Aug. 2009).*

ASM International, Materials Park, Ohio, Properties and Selection: Irons, Steels, and High-Performance Alloys, vol. 1, "Hardenability of Carbon and Low-Alloy Steels", pp. 464-484, Mar. 1990.*

English Abstract of Okonogi et al. (JP 2007-146232). (Jun. 14, 2007).*

English Abstract of Nomura (JP 62-205245) (Sep. 9, 1987).*

English Abstract of Kurokawa et al. (JP 09-256045) (Sep. 30, 1997).*

English Abstract of Fujiwara et al. (JP 2006-022350) (Jan. 26, 2006).*

English Abstract of Taji et al. (JP 2006-233237). (Sep. 7, 2006).*

English Abstract and English Machine Translation of Fujiwara, et al. (JP 2006-022350) (Jan. 26, 2006).*

International Search Report mailed on Feb. 21, 2012, issued in PCT/JP2011/076513.

Chinese Office Action for Chinese Application No. 201180032272.4 dated Sep. 5, 2013 with English language translation.

* cited by examiner

STEEL FOR NITRIDING AND NITRIDED PART

TECHNICAL FIELD

The present invention relates to a steel for nitriding having both workability before a nitriding process and strength after the nitriding process, and a nitrided part produced by subjecting the steel for nitriding to the nitriding process.

The present application claims priority based on Japanese Patent Application No. 2010-257210 filed in Japan on Nov. 17, 2010 and Japanese Patent Application No. 2010-257183 filed in Japan on Nov. 17, 2010, the disclosures of which are incorporated herein by reference in their entirety.

BACKGROUND ART

Vehicles and various kinds of industrial machines are employing a large number of surface-hardened parts for the purpose of enhancing the fatigue strength. Typical surface hardening process methods include, for example, carburizing, nitriding and induction hardening.

Unlike the other methods, the nitriding process is performed at a temperature lower than a transformation point of the steel, which makes it possible to reduce the thermal treatment distortion.

Further, the nitriding process can form the effective hardened case (hardened layer) having a depth of 100 μm or more within several hours, which makes it possible to enhance the fatigue strength.

In order to obtain steel parts exhibiting further improved fatigue strength, it is necessary to increase the depth of the effective hardened case. There is proposed a steel having an appropriate amount of alloys added therein to form nitrides, thereby obtaining the effective hardened case having predetermined hardness and depth (for example, Patent Documents 1 and 2).

Patent Document 2 discloses a steel for nitriding including: C: 0.35 weight % to 0.65 weight %, Si: 0.35 weight % to 2.00 weight %, Mn: 0.80 weight % to 2.50 weight %, Cr: 0.20 weight % or less, and Al: 0.035 weight % or less with a balance including Fe and inevitable impurities.

Patent Documents 3 to 7 propose a steel exhibiting improved workability and nitriding property by controlling a microstructure.

For example, Patent Document 5 discloses a steel for nitriding exhibiting excellent cold forgeability, which includes: by weight %, C: 0.01% to 0.15%, Si: 0.01% to 1.00%, Mn: 0.1% to 1.5%, Cr: 0.1% to 2.0%, Al: over 0.10% to 1.00%, V: 0.05% to 0.40%, and Mo: 0.10% to 1.00% with a balance including iron and inevitable impurities, in which the hardness at the core part after the hot rolling or after the hot forging is HV of 200 or less, and the upper limit compression ratio for the cold forging thereafter is 65% or more.

Patent Document 6 discloses a material for nitriding parts exhibiting excellent broaching workability, which includes: by mass %, C: 0.10% to 0.40%, Si: 0.50% or less, Mn: 0.30% to less than 1.50%, Cr: 0.30% to 2.00%, and Al: 0.02% to 0.50% with a balance including Fe and inevitable impurity elements, and the material has a bainite structure having hardness of HV210 or more.

Patent Document 7 discloses a crankshaft including, by mass %, C: 0.10% to 0.30%, Si: 0.05% to 0.3%, Mn: 0.5% to 1.5%, Mo: 0.8% to 2.0%, Cr: 0.1% to 1.0%, and V: 0.1% to 0.5% with a balance including Fe and inevitable impurities, in which: a percentage of bainite is 80% or more, the bainite being obtained in a manner such that a steel test piece satisfying 2.3%≤C+Mo+5V≤3.7%, 2.0%≤Mn+Cr+Mo≤3.0%, and 2.7%≤2.16Cr+Mo+2.54V≤4.0% and taken from a core part not receiving any effect of a nitriding process is austenited at 1200° C. for one hour, and then cooled to a room temperature at a cooling rate of 0.5° C./sec during a time when temperatures change from 900° C. to 300° C.; the Vickers hardness of the crankshaft measured in cross section is in the range of 260 HV to 330 HV; the surface hardness of a nitrided layer of a pin part and a journal part is 650 HV or more; the depth of the nitrided layer formed is 0.3 mm or more; and hardness at the core part is 340 HV or more.

Patent Document 8 discloses a steel for nitrocarburizing including, by mass %, C≤0.15%, Si≤0.5, Mn≤2.5%, Ti: 0.03% to 0.35%, and Mo: 0.03% to 0.8%. The steel has a structure in which the area percentage of bainite after nitrocarburizing is 50% or more, and fine precipitates having a grain diameter of less than 10 nm disperse in a bainite phase, and occupy 90% or more of the total precipitates.

RELATED ART DOCUMENTS

Patent Documents

Patent Document 1: Japanese Unexamined Patent Application, First Publication No. S58-71357

Patent Document 2: Japanese Unexamined Patent Application, First Publication No. H4-83849

Patent Document 3: Japanese Unexamined Patent Application, First Publication No. H7-157842

Patent Document 4: Japanese Unexamined Patent Application, First Publication No. H5-065592

Patent Document 5: Japanese Unexamined Patent Application, First Publication No. H9-279295

Patent Document 6: Japanese Unexamined Patent Application, First Publication No. 2006-249504

Patent Document 7: Japanese Unexamined Patent Application, First Publication No. 2006-291310

Patent Document 8: Japanese Unexamined Patent Application, First Publication No. 2010-163671

DISCLOSURE OF THE INVENTION

Problems to be Solved by the Invention

As compared with a steel subjected to a carburizing process, which is a currently widely available technique for enhancing the fatigue strength, the steels subjected to the nitriding process with the above-described conventional technologies have the effective hardened case with insufficient depth or the core part with lower hardness, and do not provide properties sufficient for use in an environment where large impacts or surface pressures are applied. Thus, the nitriding process has not been widely utilized, although the nitriding process has an advantage in less thermal treatment distortion. Some conventional technologies provide the sufficient depth of the effective hardened case and fatigue strength. However, the steel material before the nitriding process is hard, which leads to less workability. This means that the problem with the nitriding technique is to achieve both the workability of the steel material before the nitriding process and the fatigue strength of the parts after the nitriding process, and this problem has not yet been solved. It can be said that the excellent invention provides a steel material having a large difference between the hardness of the steel material before the nitriding process and the hardness especially of the core part after the nitriding process.

Further, the nitriding process hardens the surface layer of the steel. However, with the nitriding process, it is difficult to obtain the hardness at the core part of the steel as compared with the carburizing process. This leads to a problem of lower fatigue strength as compared with the steel subjected to the carburizing process. On the other hand, if the steel before the nitriding process is excessively hard, this steel is difficult to be cut into vehicle parts or other parts. Thus, the hardness of the steel is required to be reduced before the nitriding process.

In other words, the steel to be subjected to the nitriding process needs to have the above-described characteristics, that is, to have opposite properties in which the steel has reduced hardness before the nitriding process, whereas, after the nitriding process, the steel has deepened effective hardened case and sufficiently enhanced hardness at the core part. More specifically, the hardness of the steel is HV230 or less, preferably HV200 or less before the nitriding process; the depth of the effective layer of the steel is 200 μm or more after the nitriding process; the hardness of the surface layer of the steel is HV700 or more after the nitriding process; and the hardness at the core part of the steel increases preferably 1.3 times or more after the nitriding process nitriding.

The workability can be improved by reducing the amount of Si in the steel. However, in the case where the amount of Si is excessively reduced, a brittle layer made of iron nitrides called a white layer is formed in the grain boundary and the surface of the steel, although the hardness of the steel before the nitriding process become lower and the workability of the steel improves. This formation of the brittle layer may lead to a reduction in the fatigue strength, in particular, in the rotating bending fatigue strength when the steel is formed into a part having a shape with a groove.

Further, with Patent Document 8, it is not possible to obtain the sufficient hardness at the core part through the nitrocarburizing process.

The present invention has been made in view of the circumstances described above, and a problem of the present invention is to provide a steel for nitriding having deepened effective hardened case and sufficient hardness at the core part after a nitriding process, and excellent workability before the nitriding process, and capable of suppressing formation of the white layer in a grain boundary and the surface of the steel to exhibit a sufficient fatigue strength, as compared with those of the conventional art, and provide a nitrided part produced by subjecting the steel for nitriding to the nitriding process.

Means for Solving the Problems

Main points of the present invention are as follows:

(1) A first aspect of the present invention provides a steel for nitriding with a composition including, by mass %: C: 0.10% to 0.20%; Si: 0.01% to 0.7%; Mn: 0.2% to 2.0%; Cr: 0.2% to 2.5%; Al: 0.01% to less than 0.19%; V: over 0.2% to 1.0%; Mo: 0% to 0.54%; N: 0.001% to 0.02%; P limited to not more than 0.05%; S limited to not more than 0.20%, and a balance including Fe and inevitable impurities, the composition satisfying Expression 1, where [V] is an amount of V by mass %, and [C] is an amount of C by mass %, in which the steel for nitriding has a microstructure containing bainite of not less than 50% in terms of an area percentage.

$$2 \leq [V]/[C] \leq 10 \quad \text{(Expression 1)}$$

(2) In the steel for nitriding according to (1) above, the composition may further contain at least one element of Ti and Nb, and a total amount of Ti and Nb may be not less than 0.01% and not more than 0.4% by mass %.

(3) In the steel for nitriding according to (1) or (2) above, [C], [Mn], [Si], [Cr], and [Mo] may satisfy Expression 2, where [C], [Mn], [Si], [Cr], and [Mo] are an amount of C, an amount of Mn, an amount of Si, an amount of Cr, and an amount of Mo, respectively, by mass %.

$$65 \leq 8.65 \times [C]^{1/2} \times (1+4.1 \times [Mn]) \times (1+0.64 \times [Si]) \times (1+2.33 \times [Cr]) \times (1+3.14 \times [Mo]) \leq 400 \quad \text{(Expression 2)}$$

(4) In the steel for nitriding according to (1) or (2) above, the composition may further contain B: 0.0003% to 0.005% by mass %, and [C], [Mn], [Si], [Cr], and [Mo] may satisfy Expression 3, where [C], [Mn], [Si], [Cr], and [Mo] are an amount of C, an amount of Mn, an amount of Si, an amount of Cr, and an amount of Mo, respectively, by mass %.

$$65 \leq 8.65 \times [C]^{1/2} \times (1+4.1 \times [Mn]) \times (1+0.64 \times [Si]) \times (1+2.33 \times [Cr]) \times (1+3.14 \times [Mo]) \times (1+1.5 \times (0.9-[C])) \leq 400 \quad \text{(Expression 3)}$$

(5) In the steel for nitriding according to any one of (1) to (4) above, an amount of Mn may be not less than 0.2% and not more than 1.0% by mass %.

(6) In the steel for nitriding according to any one of (1) to (5) above, an amount of Mo may be not less than 0.05% and not more than 0.2% by mass %, and an amount of V may be not less than 0.3% and not more than 0.6% by mass %.

(7) In the steel for nitriding according to any one of (1) to (6) above, [C], [Mn], [Cr], [Mo], and [V] may satisfy Expression 4, where [C], [Mn], [Cr], [Mo], and [V] are an amount of C, an amount of Mn, an amount of Cr, an amount of Mo, and an amount of V, respectively, by mass %.

$$0.50 \leq [C]+\{[Mn]/6\}+\{([Cr]+[Mo]+[V])/5\} \leq 0.80 \quad \text{(Expression 4)}$$

(8) A second aspect of the present invention provides a nitrided part with a composition including, by mass %: C: 0.10% to 0.20%; Si: 0.01% to 0.7%; Mn: 0.2% to 2.0%; Cr: 0.2% to 2.5%; Al: 0.01% to less than 0.19%; V: over 0.2% to 1.0%; Mo: 0% to 0.54%; P limited to not more than 0.05%; S limited to not more than 0.20%; and a balance including Fe, N, and inevitable impurities, the composition satisfying Expression 5, where [V] is an amount of V by mass % and [C] is an amount of C by mass %, in which the nitrided part has a microstructure containing bainite of not less than 50% in terms of an area percentage, the nitrided part has a nitrided layer in a surface thereof, and an effective hardened case of not less than 200 μm in depth, and a Cr carbonitride precipitated in a steel contains V, or Mo and V of not less than 0.5%.

$$2 \leq [V]/[C] \leq 10 \quad \text{(Expression 5)}$$

(9) In the nitrided part according to (8) above, the composition may further include at least one element of Ti and Nb, and a total amount of Ti and Nb may be not less than 0.01% and not more than 0.4% by mass %.

(10) In the nitrided part according to (8) or (9) above, [C], [Mn], [Si], [Cr], and [Mo] may satisfy Expression 6, where [C], [Mn], [Si], [Cr], and [Mo] are an amount of C, an amount of Mn, an amount of Si, an amount of Cr, and an amount of Mo, respectively, by mass %.

$$65 \leq 8.65 \times [C]^{1/2} \times (1+4.1 \times [Mn]) \times (1+0.64 \times [Si]) \times (1+2.33 \times [Cr]) \times (1+3.14 \times [Mo]) \leq 400 \quad \text{(Expression 6)}$$

(11) In the nitrided part according to (8) or (9) above, the composition may further contain B: 0.0003% to 0.005% by mass %, and [C], [Mn], [Si], [Cr], and [Mo] may satisfy Expression 7, where [C], [Mn], [Si], [Cr], and [Mo] are an amount of C, an amount of Mn, an amount of Si, an amount of Cr, and an amount of Mo, respectively, by mass %.

$$65 \leq 8.65 \times [C]^{1/2} \times (1+4.1 \times [Mn]) \times (1+0.64 \times [Si]) \times (1+2.33 \times [Cr]) \times (1+3.14 \times [Mo]) \times (1+1.5 \times (0.9-[C])) \leq 400 \quad \text{(Expression 7)}$$

(12) In the nitrided part according to any one of (8) to (11) above, an amount of Mn may be not less than 0.2% and not more than 1.0% by mass %.

(13) In the nitrided part according to any one of (8) to (12) above, an amount of Mo may be not less than 0.05% and not more than 0.2% by mass %, and an amount of V may be not less than 0.3% and not more than 0.6% by mass %.

(14) In the nitrided part according to any one of (8) to (13) above, [C], [Mn], [Cr], [Mo], and [V] may satisfy Expression 8, where [C], [Mn], [Cr], [Mo], and [V] are an amount of C, an amount of Mn, an amount of Cr, an amount of Mo, and an amount of V, respectively, by mass %.

$$0.50 \leq [C]+\{[Mn]/6\}+\{([Cr]+[Mo]+[V])/5\} \leq 0.80 \quad \text{(Expression 8)}$$

Effects of the Invention

According to the present invention, it is possible to provide a steel for nitriding having reduced hardness before a nitriding process, and capable of obtaining deepened effective hardened case and sufficient hardness at the core part of the steel through the nitriding process, and a nitrided part produced by subjecting the steel for nitriding to the nitriding process, whereby it is possible to provide a part exhibiting reduced thermal treatment distortion and enhanced fatigue strength.

EMBODIMENTS OF THE INVENTION

Figure 1:
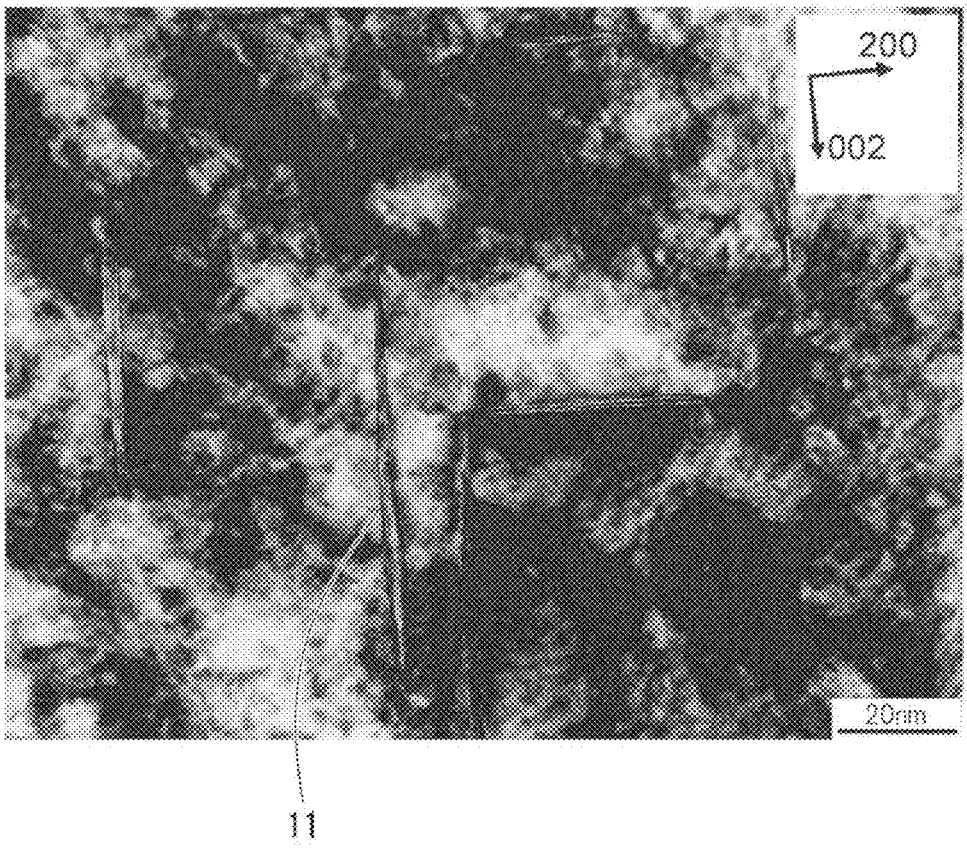
FIG. 1 is a TEM image of an effective hardened case of a part obtained by subjecting a conventional steel material to a nitriding process.

The present inventors made a keen study of components of a steel and a microstructure to solve the problems described above.

As a result, the present inventors found that, by adding Cr and V to a steel in a complex manner, or adding Cr, V, and Mo to the steel in a complex manner to make Cr carbonitrides contain Mo and/or V, it is possible to efficiently enhance the strength of the steel, and prevent the dispersion of nitrogen from being inhibited as much as possible during the nitriding process, so that the deepened effective hardened case can be obtained.

Further, C hardens the steel before the nitriding process, and reduces the workability, and hence the amount of C needs to be lowered as much as possible. However, the present inventors found that, by appropriately setting the steel components, it is possible to obtain the sufficient hardenability and the hardness at the core part of the steel after the nitriding process even if the amount of C is low.

Yet further, Si hardens the steel before the nitriding process, and reduces the workability. Thus, it is necessary to appropriately set the amount of Si added in the steel in order to prevent generation of the white layer in the grain boundary and the surface of the steel and reduction in the fatigue strength. The present inventors found appropriate steel components that does not increase the hardness of the steel before the nitriding process, even if Si is added to the extent that can prevent generation of the white layer and reduction in the fatigue strength.

Yet further, by precipitation hardening with V carbides, it is possible to harden the core part of the steel after the nitriding process. The present inventors found that, by setting the amount of V in the steel so as to be sufficiently larger than that of C, the effect obtained from V can be enhanced, so that it is possible to obtain a part having a fatigue strength equal to the part obtained through carburizing.

Yet further, the present inventors found that, by forming the microstructure so as to be occupied mainly by bainite, elements effective in precipitation hardening before the nitriding process can be sufficiently solid solved in the steel, so that it is possible to improve the depth of the effective hardened case and the hardness at the core part of the steel after the nitriding process.

Hereinbelow, a detailed description will be made of embodiments of the present invention made on the basis of the above-described findings.

The term "steel for nitriding" represents a steel material used as a material for a nitrided part. The steel for nitriding can be obtained by applying, for example, hot working or cold working to a steel strip, a bar steel or other steel materials depending on application.

The term "nitrided part" represents a part obtained by subjecting the steel for nitriding to a nitriding process.

The term "nitriding process" represents a process in which nitrogen is dispersed in a surface layer of the steel for nitriding to harden the surface layer thereof. Typical nitrogen processes include gas nitriding, plasma nitriding, gas nitrocarburizing, and salt-bath nitrocarburizing. Of these nitriding processes, the gas nitrocarburizing and the salt-bath nitrocarburizing are a nitrocarburizing process in which nitrogen and carbon are dispersed at the same time. Further, it is possible to determined whether a product is a nitrided part or not, by checking the hardness of the surface layer and whether the concentration of nitrogen in the surface layer is higher than that in the core part of the product.

The term "hot working" represents a generic name of hot rolling and hot forging. More specifically, the term "hot working" represents a working process of heating a steel material to 1000° C. or more and then forming a shape of it.

The term "depth of the effective hardened case" represents a distance measured from the surface to a depth at which HV reaches 550 in accordance with a method of measuring the depth of the effective hardened case of the carburized steel specified in JIS G 0557.

First Embodiment

A first embodiment of the present invention relates to a steel for nitriding having a predetermined component and microstructure.

Next, the component will be described. Note that the unit "%" means "mass %" and represents the contained amount. Further, the expressions [C], [Mn], [Si], [Cr], [Mo], and [V] represent the amount of elements in unit of mass %.

C: 0.10% to 0.20%

C is an element necessary to obtain hardenability and make a microstructure formed mainly by bainite. C is an element that makes alloy carbides precipitate during the nitriding process, and contributes to precipitation hardening. In the case where the amount of C is less than 0.10%, the desired strength cannot be obtained. In the case where the amount of C exceeds 0.20%, the working for the steel material is made difficult.

Thus, the upper limit of the amount of C is set to 0.20%, preferably 0.18%, and more preferably less than 0.15%. The lower limit is set to 0.10%, preferably 0.11%, and more preferably 0.12%.

Si: 0.01% to 0.7%

With the amount of Si of 0.01% or more, Si functions as deoxidizing agent, and suppresses the generation of the white layer in the surface and the grain boundary after the nitriding process to prevent the reduction in the fatigue strength. On the other hand, with the amount of Si of over 0.7%, Si does not contribute to improvement of the surface hardness in the nitriding process, and makes the depth of the effective hardened case shallow. Thus, the amount of Si is set to 0.01% to 0.7% in order to increase both "depth of the effective hardened case" and "fatigue strength".

The upper limit of the amount of Si is set to 0.7%, preferably 0.5%, and more preferably 0.3%. The lower limit is set to 0.01%, preferably 0.05%, and more preferably 0.1%.

Mn: 0.2% to 2.0%

Mn is an element necessary to obtain hardenability and make a microstructure formed mainly by bainite. In the case where the amount of Mn is less than 0.2%, sufficient hardenability cannot be obtained. In the case where the amount of Mn exceeds 2.0%, the microstructure is likely to contain martensite, which makes working difficult. If the large amount of Mn is added, Mn interferes with nitrogen, which prevents diffusion of nitrogen. Thus, in order to efficiently obtain the effect of the nitriding process, it is preferable to set the amount of Mn to 1.0% or less.

Thus, the upper limit of the amount of Mn is set to 2.0%, preferably 1.5%, and more preferably 1.0%. The lower limit of the amount of Mn is set to 0.2%, preferably 0.35%, and more preferably 0.5%.

Cr: 0.2% to 2.5%

Cr is an element that forms carbonitrides with C existing in the steel and N entering the steel during the nitriding process, and significantly enhances the hardness of the surface through precipitation hardening of the carbonitrides. In the case where the amount of Cr is less than 0.2%, the sufficient depth of the effective hardened case cannot be obtained. In the case where the amount of Cr exceeds 2.5%, the effect obtained by Cr saturates. If the large amount of Cr is added, Cr interferes with nitrogen, which prevents diffusion of nitrogen. Thus, in order to efficiently obtain the effect of the nitriding process, it is preferable to set the amount of Cr to 1.3% or less.

Thus, the upper limit of the amount of Cr is set to 2.5%, preferably 1.8%, and more preferably 1.3%. The lower limit of the amount of Cr is set to 0.2%, preferably 0.35%, and more preferably 0.5%.

Al: 0.01% to less than 0.19%

Al is an element necessary as a deoxidation element, and forms nitrides with N entering during the nitriding process, which significantly enhances the hardness of the surface. As is the case with Si, the excessive amount of Al added makes the effective hardened case shallow. In the case where the amount of Al is less than 0.01%, oxygen cannot be sufficiently removed during production of steel, and the hardness of the surface may not be sufficiently increased. In the case where the amount of Al added is 0.19% or more, the depth of the effective hardened case is shallow. In order to obtain further deep effective hardened case, it is preferable to set the amount of Al to less than 0.1%. From the viewpoint of facilitating the removal of oxygen during production of steel, it is preferable to set the amount of Al to 0.02% or more.

Thus, the upper limit of the amount of Al is set to less than 0.19%, preferably less than 0.15%, and more preferably less than 0.1%. The lower limit of the amount of Al is set to 0.01%, preferably 0.02%, and more preferably 0.03%.

V: over 0.2% to 1.0%

V forms carbides with C in the steel, N entering during the nitriding process and N in the steel, or forms composite carbonitride with Cr to enhance the surface hardness and deepen the effective hardened case. Further, V has an effect of forming V carbides with C and causing precipitation hardening to enhance the hardness at the core part of the steel after the nitriding process.

Thus, V is a particularly important element for the steel for nitriding according to the present invention. In order to sufficiently obtain the effect described above, it is necessary to set the amount of V to over 0.2%. If the amount of V added exceeds 1.0%, damage is likely to occur during the rolling, and the manufacturability deteriorates.

Thus, the upper limit of the amount of V is set to 1.0%, preferably 0.8%, and more preferably 0.6%. The lower limit of the amount of V is set to over 0.2%, preferably 0.3%, and more preferably 0.4%.

[V]/[C]: 2 to 10

Further, in order to sufficiently obtain the effect of increasing the hardness at the core part through precipitation hardening with V carbides, the amount of V needs to be sufficiently added relative to the amount of C. Since V disperses slowly as compared with C, the larger amount of V needs to be added as compared with the amount of C. In the case where V is added in a manner such that a ratio [V]/[C], which is a ratio of the amount of V relative to the amount of C, exceeds 10, it is not possible to obtain any effect corresponding to the amount of V added. On the other hand, in the case where V is added in a manner such that the ratio [V]/[C] is less than 2, the sufficient degree of precipitation hardening cannot be obtained. Thus, it is necessary to set the amount of V and the amount of C so as to satisfy $2 \leq [V]/[C] \leq 10$.

From the viewpoint of manufacturability, the upper limit of [V]/[C] is set preferably to 8, more preferably to 5. Further, from the viewpoint of the degree of precipitation hardening, the lower limit of [V]/[C] is set preferably to 3, more preferably to 4. With this setting, it is possible to enhance the hardness at the core part of the steel after the nitriding process, and obtain the fatigue strength equal to the carburized part.

Thus, the upper limit of [V]/[C] is set to 10, preferably 8, and more preferably 5. The lower limit of [V]/[C] is set to 2, preferably 3, and more preferably 4.

Mo: 0% to 0.54%

Mo is an element effective in obtaining the hardenability and making a microstructure formed mainly by bainite. Mo forms carbonitrides with N entering during the nitriding process and C in the steel, or form complex carbonitrides with Cr to enhance the surface hardness and deepen the effective hardened case. However, the effect obtained by addition of Mo can also be obtained by addition of V, and hence, the addition of Mo is not always necessary. If Mo is excessively added, damage is likely to occur during the rolling, and the manufacturability deteriorates. Further, Mo is an element having a high solid-solution strengthening ability, and hence, the hardness of the steel before the nitriding process is excessively high.

Thus, the upper limit of the amount of Mo is set to 0.54%, preferably 0.35%, and more preferably 0.2%. The lower limit of the amount of Mo is set to 0%, preferably 0.05%, and more preferably 0.1%.

As described above, the effect obtained by addition of Mo can be obtained by addition of V. In the case of adding both Mo and V, it is possible to obtain the high surface hardness and the deepened effective hardened case in a synergistic manner. More specifically, it is preferable that the amount of Mo is set between 0.05% and 0.2%, and the amount of V is set between 0.3% and 0.6%.

N: 0.001% to 0.02%

In the case where the amount of N exceeds 0.02%, the ductility in the high temperature range deteriorates. This leads to cracks during hot rolling or hot forging, deteriorating the productivity. On the other hand, the reduction in the amount of N to 0.001% or less increases the cost required for manufacturing the steel, which is not economically desirable.

Thus, the upper limit of the amount of N is set to 0.02%, preferably 0.01%, and more preferably 0.008%. The lower limit of the amount of N is set to 0.001%, preferably 0.002%, and more preferably 0.003%.

P: 0.05% or less

P is an impurity. If the amount of P exceeds 0.05%, P makes the grain boundary in the steel brittle, and deteriorates the fatigue strength. From the viewpoint of steel manufacturing cost, the lower limit value of P is set preferably to 0.0001%.

Thus, the upper limit of the amount of P is set to 0.05%, preferably 0.04%, and more preferably 0.03%. The lower limit of the amount of P is set to 0%, 0.0001%, or 0.0005%.

S: 0.20% or less

S forms MnS in the steel, improving machinability. In the case where the amount of S is less than 0.0001%, the effect obtained by S is not sufficient. On the other hand, in the case where the amount of S exceeds 0.20%, S is segregated in the grain boundary, causing grain boundary embrittlement.

Thus, the upper limit of the amount of S is set to 0.20%, preferably 0.10%, and more preferably 0.05%. The lower limit of the amount of S is set to 0%, 0.0001%, or 0.0005%.

It is preferable that the amount of C, Mn, Si, Cr, and Mo is set such that a hardenability multiplying factor $\alpha$ expressed by the following Expression A is 65 or more from the viewpoint of securing hardenability, and is 400 or less from the viewpoint of workability of hot working and cold working.

$$\text{Hardenability multiplying factor } \alpha = 8.65\times[C]^{1/2}\times(1+4.1\times[Mn])\times(1+0.64\times[Si])\times(1+2.33\times[Cr])\times(1+3.14\times[Mo]) \quad \text{(Expression A)}$$

The term "hardenability multiplying factor" represents a value indicating how an alloying element has an effect on hardenability. This expression is based on Tables 5-11 on page 250 of "Steel Material" written by Kaizo Monma and published by Jikkyo Shuppan (Tokyo) in 2005.

Ti+Nb: 0.01% to 0.4%

Ti and Nb are elements effective in obtaining hardenability, and making a microstructure formed mainly by bainite, and it may be possible to add either one of Ti and Nb or both of Ti and Nb. As is the case with Mo and V, Ti and Nb form carbonitrides with N entering during the nitriding process and C existing in the steel, and are effective in enhancing the surface hardness and deepening the effective hardened case.

In the case where the total amount of Ti and Nb is less than 0.01%, the effect obtained by Ti and Nb is not sufficient. On the other hand, in the case where the total amount of Ti and Nb exceeds 0.4%, not all the amount of Ti and Nb become solid solution, and the effect obtained by Ti and Nb saturates.

Thus, the upper limit of the total amount of Ti and Nb is set to 0.4%, preferably 0.35%, and more preferably 0.30%. The lower limit of the total amount of Ti and Nb is set to 0%, preferably 0.01%, and more preferably 0.05%.

B: 0% to 0.005%

With the amount of B of 0.0003% or more, B is an element effective in improving hardenability, and making the microstructure formed mainly by bainite, and may be selectively added to the steel. In the case where the amount of B is less than 0.0003%, the effect obtained by addition of B cannot be sufficiently obtained. On the other hand, in the case where the amount of B exceeds 0.005%, the effect obtained by B saturates.

Thus, the upper limit of the amount of B is set to 0.005%, preferably 0.004%, and more preferably 0.003%. The lower limit of the amount of B is set to 0%, preferably 0.0003%, and more preferably 0.0008%.

In the case where B is added, it is preferable that a hardenability multiplying factor is 65 or more from the viewpoint of securing hardenability, and is 400 or less from the viewpoint of workability of cold working and forging working. The above-described hardenability multiplying factor can be obtained by the following Expression B as a hardenability multiplying factor $\beta$.

$$\text{Hardenability multiplying factor } \beta = 8.65\times[C]^{1/2}\times(1+4.1\times[Mn])\times(1+0.64\times[Si])\times(1+2.33\times[Cr])\times(1+3.14\times[Mo])\times(1+1.5\times(0.9-[C])) \quad \text{(Expression B)}$$

This expression is based on Tables 5-11 on page 250 of "Steel Material" written by Kaizo Monma and published by Jikkyo Shuppan (Tokyo) in 2005.

Carbon Equivalent: 0.50 to 0.80

It is preferable that components of the steel for nitriding are set such that a carbon equivalent (Ceq.) obtained by $[C]+\{[Mn]/6\}+\{([Cr]+[Mo]+[V])/5\}$ is not less than 0.50 and not more than 0.80. By setting the carbon equivalent to not less than 0.50 and not more than 0.80, the carbon equivalent functions advantageously in generating bainite, which will be described later, and it is possible to avoid the excessive increase in the hardness of the steel before the nitriding process. With this function, a desired hardness after hot forging can be obtained.

The Remainder: Fe and Inevitable Impurities

The components of the steel for nitriding according to this embodiment may contain elements other than those described above or other impurities inevitably intruding in the steel during the production processes. However, it is preferable to reduce such impurities as much as possible. Note that the nitrided part obtained by subjecting the steel for nitriding to the nitriding process contains Fe, N and inevitable impurities as the remainder.

Next, a microstructure of the steel for nitriding according to this embodiment will be described.

The microstructure of the steel for nitriding according to this embodiment has bainite of 50% or more in terms of an area percentage.

In order to improve the depth of the effective hardened case, the steel for nitriding needs to be sufficiently precipitation hardened during the nitriding process to enhance the hardness of the steel. Thus, alloying elements necessary for precipitation needs to be sufficiently in solid solution in the steel for nitriding before the nitriding process. To obtain this state, use of martensite or bainite is suitable.

However, given the workability in cold forging and cutting work, the microstructure formed mainly by martensite has excessively high hardness, and thus, is not suitable. Hence, the microstructure formed mainly by bainite is most suitable. Further, in order to sufficiently cause the precipitation hardening, the microstructure needs to have bainite of 50% or more in terms of the area percentage. In order to more effectively cause the precipitation hardening, it is desirable that the microstructure has bainite of 70% or more in terms of the area percentage. The microstructure of the remaining part other than bainite is formed by one or more types of ferrite, pearlite, and martensite.

Bainite of the microstructure can be observed with an optical microscope by subjecting the steel to a mirror surface finish, and then etching the steel with a nital solution. For example, five views of an area corresponding to a position at which hardness is measured are observed using an optical microscope with a 500× magnification, and photographs thereof are taken. The area percentage of bainite can be obtained by image analyzing the thus obtained photographs.

The steel for nitriding may be a steel material subjected to casting and without applying any treatment thereafter, or may be a steel material subjected to casting and then subjected to hot working or cold working depending on applications.

In the case where the steel for nitriding is produced without subjecting a steel material to hot working or thermal treatment, the microstructure of the steel material needs to have bainite of 50% or more in terms of the area percentage.

In the case where a steel material is subjected to hot working to produce the steel for nitriding, it is preferable that the steel material has a microstructure having bainite of 50% or more. This is because, with this setting, it is easy to obtain the steel for nitriding having the microstructure having bainite of 50% or more in terms of the area percentage in the final hot working.

However, in the case where a steel material is subjected to hot working to produce the steel for nitriding having the microstructure with bainite of 50% or more in terms of the area percentage, it may be possible that the microstructure of the steel material does not contain bainite of 50% or more. This is because, even if the microstructure of the steel material before the hot working has, for example, a two-phase structure including ferrite and pearlite, the entire microstructure once becomes austenite through hot working, and changes into bainite during the cooling process after the hot working. This means that it is only necessary that the microstructure of the steel for nitriding has bainite of 50% or more.

The microstructure having bainite of 50% or more can be obtained by controlling hot rolling for producing the steel for nitriding, or hot forging for producing the nitrided part. More specifically, it can be obtained by setting temperatures for hot rolling or hot forging, and/or cooling rate after hot rolling or hot forging.

In the case where heating temperatures before hot rolling and hot forging are less than 1000° C., resistance against deformation increases, which increases costs. Further, the alloying elements added are not sufficiently dissolved in solid solution, which reduces the hardenability, and reduces the area percentage of bainite. Thus, it is preferable to set the heating temperatures before rolling and forging to 1000° C. or more. In the case where the heating temperatures exceed 1300° C., the austenite grain boundary coarsens. Thus, it is preferable to set the heating temperatures to 1300° C. or less.

With the steel material containing the above-described components, in the case where the cooling rate at which the steel material is cooled to 500° C. after hot rolling or hot forging is less than 0.1° C./sec, the area percentage of bainite reduces or ferrite and pearlite increase. Thus, it is preferable to set the cooling rate to 0.1° C./sec or more. In the case where the cooling rate exceeds 10° C./sec, martensite increases, and the strength before cold forging or cutting work increase, which leads to an increase in costs. Thus, it is preferable to set the cooling rate to 10° C./sec or less.

By applying a nitriding process to the steel for nitriding produced through hot rolling under the above-described conditions and formed into a desired shape through cold working such as cold forging and cutting work, it is possible to improve the fatigue strength while reducing distortion.

Second Embodiment

Next, a nitrided part according to a second embodiment of the present invention will be described.

The nitrided part according to this embodiment can be obtained by applying a nitrocarburizing process to the steel for nitriding described in the first embodiment. Components of the nitrided part are the same as those in the first embodiments, and detained description thereof will not be repeated. However, the amount of N largely varies depending on conditions of the nitriding process, and thus, is not set in this embodiment.

The nitrided part needs to have a microstructure in which an area percentage of 50% or more is formed by bainite. The area percentage of bainite in the nitrided part can be obtained in a similar manner in which the area percentage of bainite in the steel for nitriding is obtained.

By applying a nitrocarburizing process to the steel for nitriding according to the first embodiment, it is possible to obtain a nitrided part in which Cr carbonitrides precipitated in the steel contain V, or Mo and V of 0.5% or more. More specifically, in order to obtain Cr carbonitrides containing V, or Mo and V of 0.5% or more, a nitriding process is applied to a microstructure having bainite of 50% or more and containing Mo: 0% to 0.54%, and V: over 0.2% to 1.0%. With this application, it is possible to obtain excellent surface hardness and improved depth of the effective hardened case. Note that a mechanism of hardening the surface layer through the nitriding process is considered to be precipitation hardening obtained with nitrides of alloys or iron, or solid solution strengthening with nitrogen.

It can be examined whether or not the Cr carbonitrides contain V and Mo, by using an x-ray element analyzer or other devices. It is only necessary that the x-ray element analyzer or other device has an accuracy with which an element of 0.5% or more can be detected.

The nitriding process applied is a gas nitrocarburizing process applied, for example, with a mixture gas of $N_2$+$NH_3$+$CO_2$ for 10 hours at 580° C. With this process, it is possible to obtain an effective hardened case having surface hardness of HV700 or more, and the depth of the effective hardened case of 200 μm or more. In other words, within an industrially practical time period, it is possible to obtain sufficient surface hardness, deepened effective hardened case as compared with the conventional steel material, and sufficient hardness at the core part.

Figure 2:
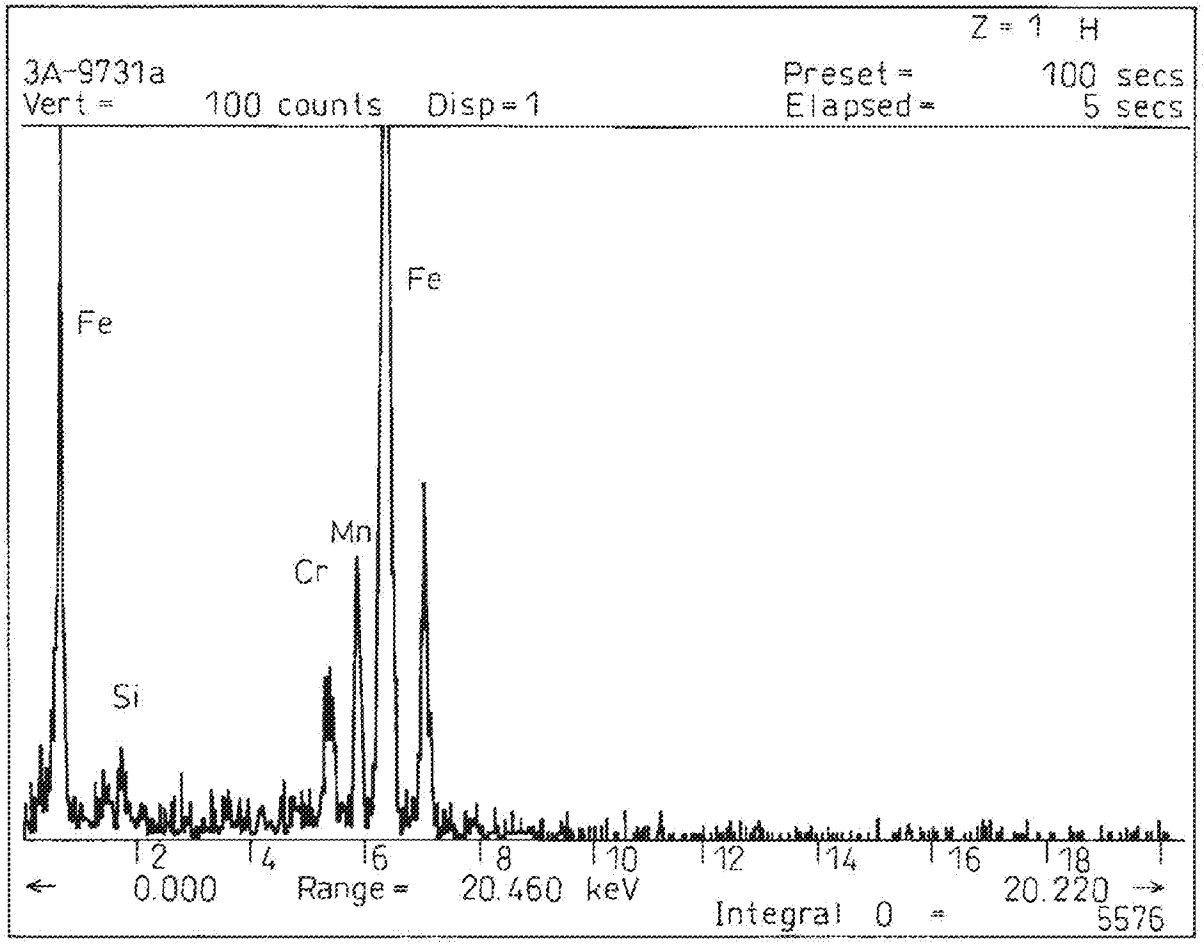
FIG. 2 is a diagram showing results of component analysis, with an x-ray element analyzer, of Cr carbonitrides in the effective hardened case of the part obtaining by subjecting the conventional steel material to the nitriding process.

FIG. 1 shows observation results of an effective hardened case of a part obtained by subjecting a conventional CrMn steel to a gas nitrocarburizing process and using a transmission electron microscopy. FIG. 2 shows results of component analysis of an effective hardened case part in the Cr carbonitrides using the x-ray element analyzer.

Figure 3:
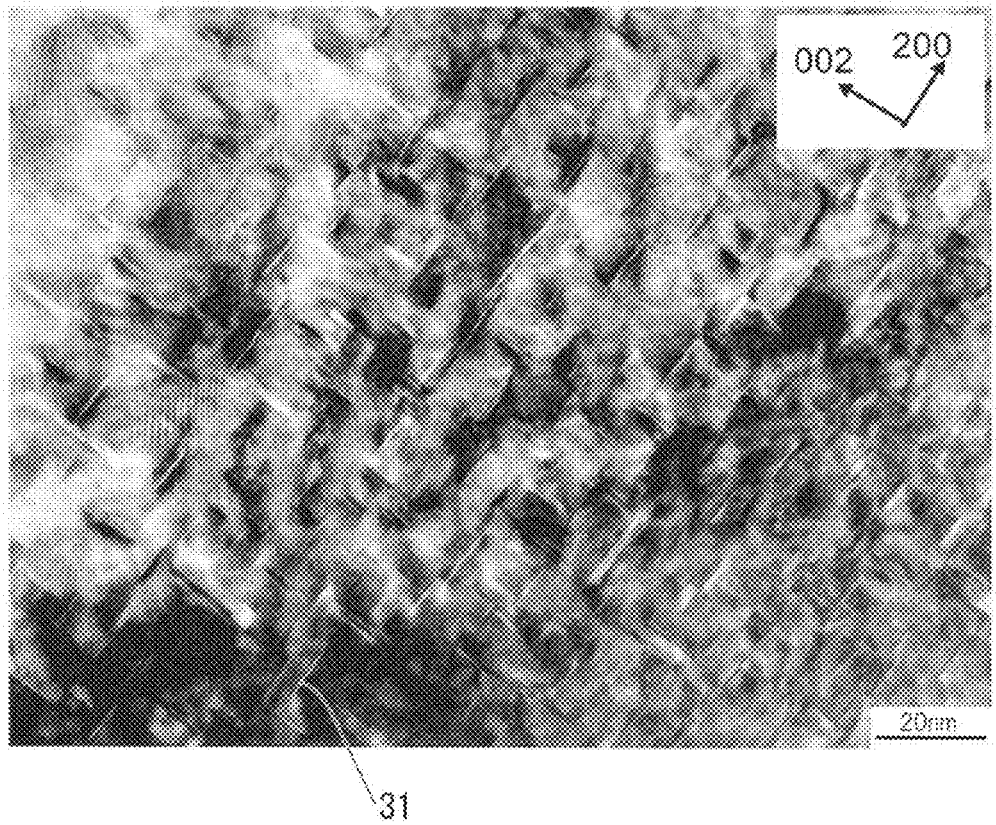
FIG. 3 is a TEM image of an effective hardened case of a part obtained by subjecting a steel material according to the present invention to the nitriding process.

FIG. 3 shows observation results of an effective hardened case of a part obtained by subjecting a CrMoV steel according to the present invention to a gas nitrocarburizing process and using a transmission microscopy. As compared with the conventional part obtained through the gas nitrocarburizing, it can be understood that a large volume of fine Cr carbonitrides precipitate, and the precipitation hardening is sufficiently formed.

Figure 4:
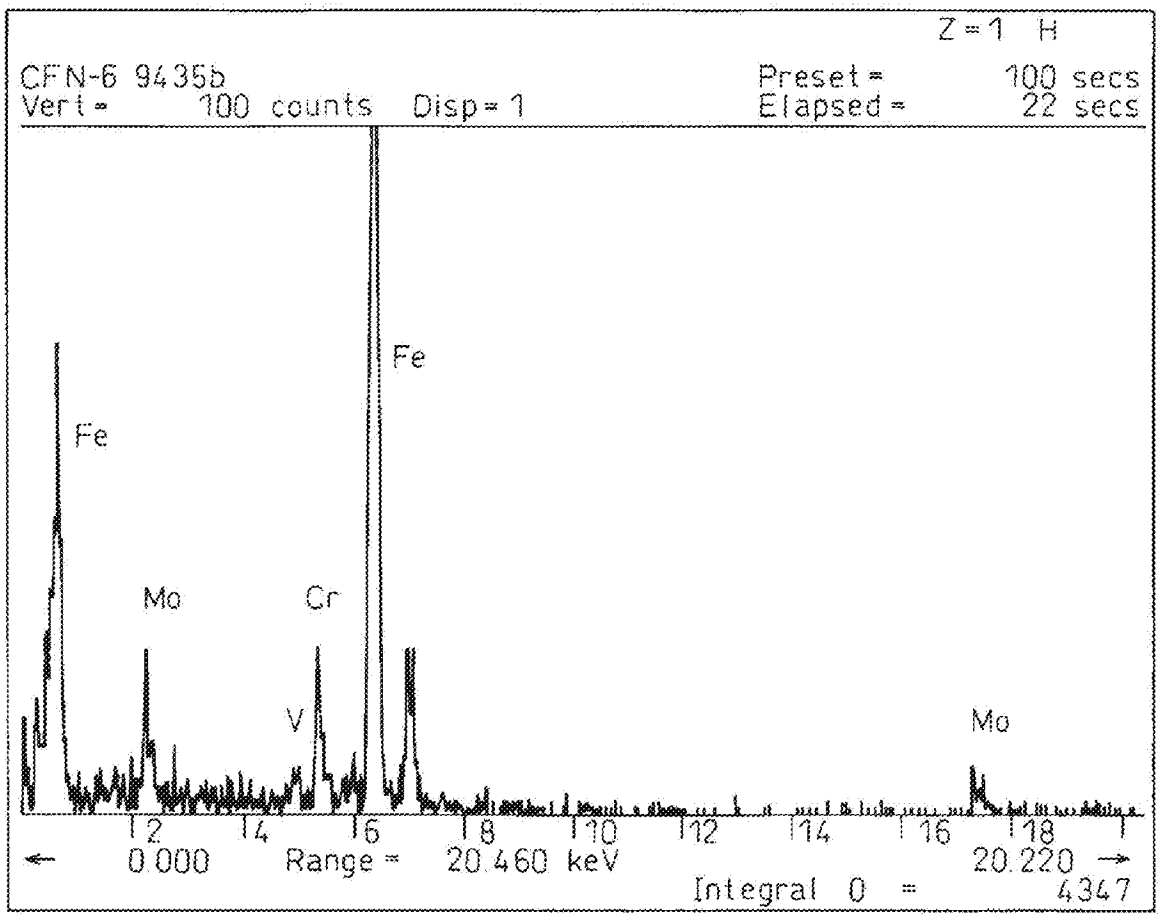
FIG. 4 is a diagram showing results of component analysis, with the x-ray element analyzer, of Cr carbonitrides in the effective hardened case of the part obtained by subjecting the steel material according to the present invention to the nitriding process.

FIG. 4 shows results of analysis of components in Cr carbonitrides in an effective hardened case portion of the part according to the present invention using an x-ray element analyzer. From the results, it can be understood that Mo and V are contained in the Cr carbonitrides.

Example 1

For Experiment Examples A1 to A36, steels having components shown in Table 1 and Table 2 were smelted. P in Table 2 indicates the amount of P detected as an inevitable impurity, which is not intentionally added. The character "-" in Table 1 and Table 2 indicates that the element is intentionally not added. "Hardenability multiplying factor" in Table 2 is a value obtained from $8.65\times[C]^{1/2}\times(1+4.1\times[Mn])\times(1+0.64\times[Si])\times(1+2.33\times[Cr])\times(1+3.14\times[Mo])$ in the case of Experiment Example that does not contain B, and is a value obtained from $8.65\times[C]^{1/2}\times(1+4.1\times[Mn])\times(1+0.64\times[Si])\times(1+2.33\times[Cr])\times(1+3.14\times[Mo])\times(1+1.5\times(0.9-[C]))$ in the case of Experiment Example that contains B.

Further, "Ceq" is a value obtained from $[C]+\{[Mn]/6\}+\{([Cr]+[Mo]+[V])/5\}$.

TABLE 1

| Experiment example | C | Si | Mn | Cr | Al | V | Mo | N |
|---|---|---|---|---|---|---|---|---|
| A1 | 0.10 | 0.05 | 1.98 | 0.46 | 0.02 | 0.32 | 0.49 | 0.0036 |
| A2 | 0.12 | 0.04 | 0.55 | 1.53 | 0.08 | 0.28 | 0.45 | 0.0063 |
| A3 | 0.11 | 0.06 | 0.64 | 1.20 | 0.03 | 0.22 | 0.48 | 0.0052 |
| A4 | 0.13 | 0.05 | 0.75 | 0.98 | 0.03 | 0.99 | 0.04 | 0.0096 |
| A5 | 0.15 | 0.02 | 1.64 | 1.18 | 0.11 | 0.38 | — | 0.0084 |
| A6 | 0.20 | 0.03 | 0.22 | 1.16 | 0.04 | 0.48 | 0.26 | 0.0042 |
| A7 | 0.12 | 0.02 | 1.20 | 1.26 | 0.18 | 0.36 | 0.08 | 0.0063 |
| A8 | 0.18 | 0.01 | 1.82 | 0.32 | 0.03 | 0.74 | 0.06 | 0.0036 |
| A9 | 0.11 | 0.09 | 0.74 | 2.20 | 0.03 | 0.38 | 0.08 | 0.0059 |
| A10 | 0.11 | 0.05 | 1.22 | 1.19 | 0.03 | 0.30 | 0.24 | 0.0041 |
| A11 | 0.18 | 0.01 | 1.11 | 1.28 | 0.16 | 0.66 | — | 0.0050 |
| A12 | 0.19 | 0.02 | 0.96 | 0.83 | 0.08 | 0.48 | 0.45 | 0.0043 |
| A13 | 0.10 | 0.15 | 2.00 | 1.10 | 0.03 | 0.21 | 0.11 | 0.0030 |
| A14 | 0.11 | 0.16 | 1.66 | 1.49 | 0.06 | 0.23 | 0.22 | 0.0053 |
| A15 | 0.10 | 0.18 | 1.41 | 0.77 | 0.02 | 0.92 | 0.35 | 0.0155 |
| A16 | 0.13 | 0.16 | 1.52 | 1.10 | 0.03 | 0.40 | 0.24 | 0.0076 |
| A17 | 0.17 | 0.23 | 1.64 | 1.08 | 0.09 | 0.39 | — | 0.0036 |
| A18 | 0.20 | 0.21 | 0.34 | 1.83 | 0.06 | 0.48 | 0.27 | 0.0044 |
| A19 | 0.10 | 0.28 | 1.29 | 0.95 | 0.12 | 0.21 | 0.18 | 0.0043 |
| A20 | 0.18 | 0.12 | 0.52 | 0.47 | 0.04 | 0.74 | 0.50 | 0.0055 |
| A21 | 0.11 | 0.25 | 1.14 | 1.02 | 0.03 | 0.25 | 0.22 | 0.0047 |
| A22 | 0.19 | 0.24 | 0.74 | 0.70 | 0.09 | 0.48 | 0.41 | 0.0059 |
| A23 | 0.15 | 0.65 | 0.92 | 0.95 | 0.01 | 0.41 | 0.19 | 0.0068 |
| A24 | 0.10 | 0.24 | 1.13 | 1.32 | 0.04 | 0.22 | 0.09 | 0.0049 |
| A25 | 0.11 | 0.38 | 0.65 | 1.46 | 0.06 | 0.48 | 0.19 | 0.0058 |
| A26 | 0.12 | 0.31 | 0.83 | 1.83 | 0.05 | 0.49 | 0.14 | 0.0084 |
| A27 | 0.10 | 0.46 | 1.99 | 1.35 | 0.03 | 0.31 | 0.11 | 0.0068 |
| A28 | 0.13 | 0.51 | 1.04 | 0.78 | 0.08 | 0.29 | 0.13 | 0.0043 |
| A29 | 0.10 | 0.26 | 1.08 | 1.31 | 0.03 | 0.33 | 0.1 | 0.0046 |
| A30 | 0.07 | 0.07 | 1.57 | 0.16 | 0.10 | 0.21 | 0.16 | 0.0061 |
| A31 | 0.24 | 0.08 | 1.53 | 1.36 | 0.04 | 0.39 | 0.13 | 0.0055 |
| A32 | 0.11 | 0.82 | 1.52 | 0.42 | 0.07 | 0.22 | 0.06 | 0.0059 |
| A33 | 0.18 | 0.08 | 2.42 | 1.39 | 0.04 | 0.36 | 0.42 | 0.0055 |
| A34 | 0.19 | 0.16 | 0.89 | 0.38 | 0.19 | — | 0.25 | 0.0061 |
| A35 | 0.17 | 0.23 | 0.93 | 0.66 | 0.05 | 0.35 | 1.48 | 0.0062 |
| A36 | 0.19 | 0.11 | 1.50 | 1.18 | 0.05 | 0.21 | 0.11 | 0.0062 |

TABLE 2

| Experiment example | P | S | Ti | Nb | B | V/C | Ceq | Hardenability multiplying factor |
|---|---|---|---|---|---|---|---|---|
| A1 | 0.005 | 0.002 | 0.06 | — | — | 3.20 | 0.68 | 135 |
| A2 | 0.023 | 0.017 | 0.19 | — | — | 2.33 | 0.66 | 110 |
| A3 | 0.015 | 0.010 | — | — | — | 2.00 | 0.60 | 103 |
| A4 | 0.021 | 0.016 | — | — | — | 7.62 | 0.66 | 97 |
| A5 | 0.011 | 0.011 | — | — | — | 2.53 | 0.74 | 98 |
| A6 | 0.010 | 0.007 | — | — | — | 2.40 | 0.62 | 82 |
| A7 | 0.011 | 0.022 | 0.03 | 0.02 | 0.0008 | 3.00 | 0.66 | 192 |
| A8 | 0.013 | 0.020 | — | — | — | 4.11 | 0.71 | 65 |
| A9 | 0.019 | 0.014 | — | — | — | 3.45 | 0.77 | 151 |
| A10 | 0.012 | 0.013 | — | 0.24 | — | 2.73 | 0.66 | 118 |
| A11 | 0.013 | 0.016 | — | — | — | 3.67 | 0.75 | 82 |
| A12 | 0.010 | 0.022 | 0.27 | — | 0.0042 | 2.53 | 0.70 | 276 |
| A13 | 0.006 | 0.003 | 0.16 | — | — | 2.10 | 0.72 | 132 |
| A14 | 0.032 | 0.016 | — | — | — | 2.09 | 0.77 | 187 |
| A15 | 0.018 | 0.010 | — | — | — | 9.20 | 0.74 | 172 |
| A16 | 0.013 | 0.015 | 0.12 | — | — | 3.08 | 0.73 | 155 |
| A17 | 0.012 | 0.012 | — | — | — | 2.29 | 0.74 | 111 |
| A18 | 0.021 | 0.006 | — | — | — | 2.40 | 0.77 | 102 |
| A19 | 0.014 | 0.025 | 0.04 | 0.02 | 0.0090 | 2.00 | 0.58 | 224 |
| A20 | 0.017 | 0.011 | — | — | — | 4.11 | 0.61 | 67 |
| A21 | 0.022 | 0.021 | — | 0.22 | — | 2.27 | 0.60 | 108 |
| A22 | 0.013 | 0.024 | 0.28 | — | 0.0043 | 2.53 | 0.63 | 218 |
| A23 | 0.016 | 0.019 | — | — | — | 2.73 | 0.61 | 116 |
| A24 | 0.011 | 0.021 | 0.11 | 0.08 | — | 2.20 | 0.61 | 93 |
| A25 | 0.014 | 0.024 | — | — | 0.0021 | 4.36 | 0.64 | 201 |
| A26 | 0.010 | 0.015 | 0.08 | — | — | 4.08 | 0.75 | 120 |
| A27 | 0.009 | 0.026 | 0.12 | 0.12 | — | 3.10 | 0.79 | 181 |
| A28 | 0.019 | 0.052 | 0.18 | — | — | 2.23 | 0.54 | 86 |
| A29 | 0.020 | 0.108 | 0.04 | — | 0.0016 | 3.30 | 0.63 | 203 |
| A30 | 0.023 | 0.016 | — | — | — | 3.00 | 0.44 | 37 |
| A31 | 0.022 | 0.023 | — | — | — | 1.63 | 0.87 | 190 |
| A32 | 0.021 | 0.022 | — | — | — | 2.00 | 0.50 | 74 |

TABLE 2-continued

| Experiment example | P | S | Ti | Nb | B | V/C | Ceq | Hardenability multiplying factor |
|---|---|---|---|---|---|---|---|---|
| A33 | 0.023 | 0.016 | — | — | — | 2.00 | 1.02 | 414 |
| A34 | 0.012 | 0.014 | — | — | — | 0.00 | 0.46 | 65 |
| A35 | 0.015 | 0.021 | — | — | — | 2.50 | 0.82 | 121 |
| A36 | 0.017 | 0.022 | — | — | — | 1.11 | 0.74 | 146 |

For Experiment Examples A1 to A36, (1) steel strips having a diameter of 30 mm were produced from a steel smelted as described above, (2) the steel strips were subjected to a hot forging process under a "hot forging condition" shown in Table 3 (applying hot forging at "heating temperature (° C.)" and "cooling rate (° C./s)") to produce a hot forging member having a cylindrical shape with a thickness of 10 mm and a diameter of 35 mm, and (3) the hot forging member was cut to produce a gear-shaped member.

Table 3 shows measurement results of "area percentage (%) of bainite" and "hardness (HV) after hot forging" in Experiment Examples A1 to A36.

The "area percentage (%) of bainite" represents an area percentage of bainite at a measurement position located at a depth of one-fourth the diameter measured from the surface in cross section perpendicular to the axial direction of the hot forging member. More specifically, the "area percentage (%) of bainite" was obtained by applying mirror surface finish to the measurement position, then applying an etching process to the mirror surface with a nital solution, observing five views thereof with a 500× magnification using an optical microscope, taking photographs thereof, and image analyzing the thus obtained photographs.

Figure 6:
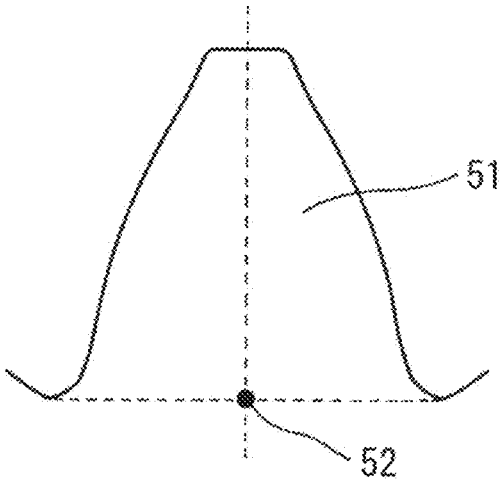
FIG. 6 is a schematic view illustrating a part of a gear produced in Example according to the present invention.

The "hardness (HV) after hot forging" represents hardness of the gear-shaped member before the nitriding process, and was obtained by cutting the gear-shaped member at a hardness measurement position 52 illustrated in FIG. 6 in a manner such that the central portion in the thickness direction appears, polishing it, and measuring HV0.3 (2.9N) in accordance with JIS Z 2244. Note that FIG. 6 illustrates a shape of a tooth 51 and the hardness measurement position 52 of the gear-shaped member.

TABLE 3

| | Hot forging condition | | Area | |
|---|---|---|---|---|
| Experiment example | Heating temperature (° C.) | Cooling rate (° C./s) | percentage (%) of bainite | Hardness (HV) after hot forging |
| A1 | 1200 | 0.3 | 78 | 218 |
| A2 | 1200 | 3.0 | 83 | 188 |
| A3 | 1200 | 3.0 | 78 | 206 |
| A4 | 1200 | 3.0 | 89 | 244 |
| A5 | 1200 | 3.0 | 82 | 181 |
| A6 | 1200 | 1.0 | 90 | 207 |
| A7 | 1250 | 10.0 | 100 | 182 |
| A8 | 1200 | 0.3 | 96 | 214 |
| A9 | 1200 | 0.8 | 76 | 198 |
| A10 | 1250 | 1.0 | 77 | 194 |
| A11 | 1200 | 0.8 | 82 | 194 |
| A12 | 1250 | 0.3 | 76 | 215 |
| A13 | 1200 | 1.0 | 98 | 199 |
| A14 | 1200 | 0.8 | 82 | 188 |
| A15 | 1200 | 0.8 | 80 | 206 |
| A16 | 1200 | 1.0 | 91 | 204 |
| A17 | 1200 | 3.0 | 94 | 186 |
| A18 | 1200 | 1.0 | 85 | 207 |

TABLE 3-continued

| | Hot forging condition | | Area | |
|---|---|---|---|---|
| Experiment example | Heating temperature (° C.) | Cooling rate (° C./s) | percentage (%) of bainite | Hardness (HV) after hot forging |
| A19 | 1250 | 10.0 | 98 | 248 |
| A20 | 1200 | 0.3 | 76 | 206 |
| A21 | 1250 | 3.0 | 71 | 194 |
| A22 | 1250 | 3.0 | 92 | 215 |
| A23 | 1200 | 10 | 100 | 185 |
| A24 | 1250 | 3 | 94 | 185 |
| A25 | 1250 | 3 | 96 | 198 |
| A26 | 1250 | 3 | 89 | 232 |
| A27 | 1250 | 3 | 91 | 244 |
| A28 | 1250 | 3 | 88 | 189 |
| A29 | 1250 | 3 | 100 | 226 |
| A30 | 1050 | 10 | 50 | 153 |
| A31 | 1050 | 0.3 | 100 | 261 |
| A32 | 1050 | 3.0 | 81 | 212 |
| A33 | 1050 | 0.8 | 100 | 298 |
| A34 | 1050 | 0.8 | 52 | 180 |
| A35 | 1050 | 0.8 | 88 | 316 |
| A36 | 1050 | 0.3 | 52 | 238 |

Next, a gas nitrocarburizing process was applied to the gear-shaped member described above to produce a nitrided gear. The gas nitrocarburizing process was applied under conditions of 580° C.×10 hrs in a mixture gas of $NH_3$:$N_2$:$H_2$:$CO_2$=50:40:5:5 in volume fracture. In the tests, $H_2$ gas was added in order to create an atmosphere in which generation of the white layer can be easily suppressed.

Table 4 relates to Experiment Examples A1 to A36, and shows measurement results of "surface hardness (HV)," "depth (μm) of the effective hardened case," "rate of increase in hardness at the core part after the gas nitrocarburizing process," "rotating bending fatigue strength (MPa) of test sample A," "rotating bending fatigue strength (MPa) of test sample B," "rotating bending fatigue strength (MPa) of test sample C," and "V, or Mo and V in Cr carbonitrides".

The "surface hardness (HV)" was obtained in accordance with JIS Z 2244 by measuring HV0.3 (2.9N) at a hardness measurement position located at a depth of 50 μm from a surface of the nitrided gear.

The "depth of the effective hardened case (μm)" was obtained by measuring a distance from the surface to a position at which HV0.3 (2.9N) reaches 550 on the basis of JIS G 0557.

The "rate of increase in hardness at the core part after the gas nitrocarburizing process" was obtained by measuring HV0.3 (2.9N) at the hardness measurement position 52 after the gas nitrocarburizing process, and is indicated as a ratio relative to the hardness before the gas nitrocarburizing process (in other words, hardness after hot forging).

Figure 5A:
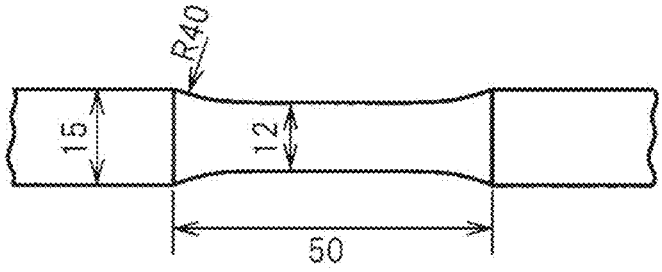
FIG. 5A is a diagram illustrating a shape of a test sample A used in a rotating bending fatigue test in Examples.
Figure 5B:
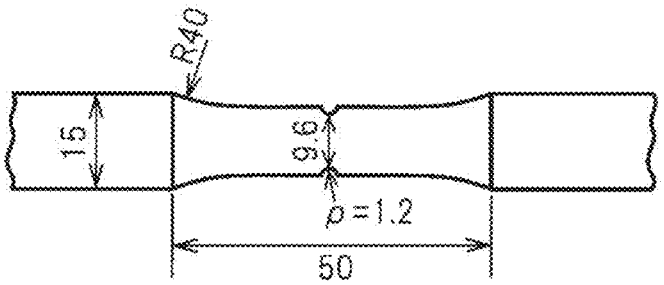
FIG. 5B is a diagram illustrating a shape of a test sample B used in the rotating bending fatigue test in Examples.
Figure 5C:
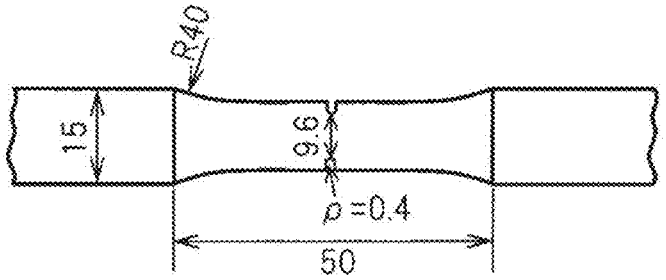
FIG. 5C is a diagram illustrating a shape of a test sample C used in the rotating bending fatigue test in Examples.

The "rotating bending fatigue strength (MPa) of test sample A", the "rotating bending fatigue strength (MPa) of test sample B", and the "rotating bending fatigue strength (MPa) of test sample C" were evaluated by:

(1) applying hot forging to the steel strip under the hot forging conditions shown in Table 3 (heating temperature and cooling rate) to produce a member having a diameter of 16 mm;

(2) subjecting this member to a cutting work, and then applying the above-described gas nitrocarburizing process to produce a test sample A, a test sample B, and a test sample C illustrated in FIG. 5A, FIG. 5B, and FIG. 5C; and (3) performing a rotating bending fatigue test to the test samples A to C, thereby obtaining the maximum stress (MPa) at which the samples withstand $10^7$ cycles.

FIG. 5A illustrates a plain test sample A without having any notch, FIG. 5B illustrates a grooved test sample B provided with a groove having a radius of curvature $\rho=1.2$ (stress concentration factor $\alpha\sim1.8$), and FIG. 5C illustrates a groove test sample C provided with a groove having a radius of curvature $\rho=0.4$ (stress concentration factor $\alpha=2.7$).

Further, a thin-film test sample was produced from the effective hardened case portion, and the effective hardened case portion was observed with a transmission electron microscopy. As a result, fine Cr carbonitrides were observed at the effective hardened case portion. Further, components of the Cr carbonitrides were analyzed with an x-ray element analyzer to examine whether the Cr carbonitrides contain Mo or V. The x-ray element analyzer used in Examples had an accuracy with which elements with 0.5% or more can be detected. The term "exist" was marked in a column of "V, or Mo and V in Cr carbonitrides" in Table 4 if it is detected that the Cr carbonitrides contain V, or Mo and V of 0.5% or more, whereas the term "not exist" was marked if it is not detected that the Cr carbonitrides contain V, or Mo and V of 0.5% or more.

From Experiment Examples A1 to A29, the nitrided gear having a surface hardness of HV700 or more and a depth of the effective hardened case of 200 μm or more could be obtained. Further, the rate of increase in hardness at the core part after the nitriding process was 1.3 or more. This confirms that it is possible to achieve both workability before the nitriding process and fatigue strength.

With Experiment Example A30, the amount of C and the amount of Cr were low, which resulted in a reduction in the hardenability multiplying factor. Thus, the nitrided gear did not have sufficient hardness and bending fatigue strength.

With Experiment Example A31, the amount of C was high, which resulted in excessively high hardness after hot forging. Thus, the cutting work could not be applied easily. In other words, application of cutting work is not preferable from viewpoint of cost.

With Experiment Example A32, the amount of Si was high, which resulted in insufficient depth of the effective hardened case. Further, the rotating bending fatigue strength was low.

With Experiment Example A33, the amount of Mn was high, which resulted in excessively high hardness after hot forging. Thus, the cutting work could not be applied easily. In other words, application of cutting work is not preferable from viewpoint of cost.

With Experiment Example A34, the amount of Al was high, and the sample did not contain V. Thus, the nitrided gear did not have sufficient hardness and bending fatigue strength.

TABLE 4

| Experiment example | Surface hardness (HV) | Depth (μm) of the effective hardened case | Rate of increase in hardness at the core part after gas nitrocarburizing process | Rotating bending fatigue strength (MPa) of test sample A | Rotating bending fatigue strength (MPa) of test sample B | Rotating bending fatigue strength (MPa) of test sample C | V, or Mo and V in Cr carbonitrides |
|---|---|---|---|---|---|---|---|
| A1 | 758 | 312 | 1.321 | 700 | 570 | 440 | Exist |
| A2 | 897 | 324 | 1.331 | 650 | 540 | 410 | Exist |
| A3 | 827 | 381 | 1.325 | 680 | 540 | 420 | Exist |
| A4 | 822 | 417 | 1.309 | 690 | 550 | 430 | Exist |
| A5 | 805 | 353 | 1.309 | 630 | 510 | 400 | Exist |
| A6 | 899 | 459 | 1.338 | 700 | 550 | 430 | Exist |
| A7 | 825 | 361 | 1.328 | 610 | 500 | 400 | Exist |
| A8 | 744 | 331 | 1.327 | 710 | 580 | 450 | Exist |
| A9 | 852 | 430 | 1.313 | 650 | 540 | 430 | Exist |
| A10 | 751 | 367 | 1.314 | 660 | 540 | 420 | Exist |
| A11 | 839 | 385 | 1.366 | 690 | 560 | 440 | Exist |
| A12 | 813 | 400 | 1.326 | 710 | 560 | 440 | Exist |
| A13 | 837 | 381 | 1.311 | 650 | 550 | 440 | Exist |
| A14 | 829 | 308 | 1.319 | 620 | 530 | 430 | Exist |
| A15 | 843 | 341 | 1.340 | 680 | 550 | 450 | Exist |
| A16 | 798 | 322 | 1.319 | 650 | 560 | 460 | Exist |
| A17 | 766 | 289 | 1.301 | 610 | 510 | 420 | Exist |
| A18 | 952 | 364 | 1.338 | 670 | 540 | 450 | Exist |
| A19 | 779 | 308 | 1.308 | 710 | 580 | 480 | Exist |
| A20 | 1038 | 327 | 1.393 | 660 | 560 | 470 | Exist |
| A21 | 731 | 312 | 1.309 | 620 | 540 | 450 | Exist |
| A22 | 789 | 301 | 1.330 | 660 | 580 | 470 | Exist |
| A23 | 808 | 312 | 1.318 | 620 | 530 | 430 | Exist |
| A24 | 739 | 336 | 1.361 | 620 | 530 | 420 | Exist |
| A25 | 888 | 402 | 1.337 | 630 | 550 | 430 | Exist |
| A26 | 964 | 418 | 1.354 | 700 | 570 | 460 | Exist |
| A27 | 769 | 339 | 1.347 | 710 | 580 | 480 | Exist |
| A28 | 798 | 362 | 1.423 | 670 | 570 | 480 | Exist |
| A29 | 821 | 344 | 1.249 | 690 | 530 | 430 | Exist |
| A30 | 692 | 277 | 1.025 | 480 | 380 | 310 | Exist |
| A31 | — | — | — | — | — | — | Exist |
| A32 | 816 | 255 | 1.300 | 570 | 500 | 360 | Exist |
| A33 | — | — | — | — | — | — | Exist |
| A34 | 548 | 202 | 0.955 | 490 | 400 | 320 | Exist |
| A35 | — | — | — | — | — | — | Exist |
| A36 | 732 | 321 | 1.162 | 580 | 500 | 370 | Exist |

With Experiment Example A35, the amount of Mo was high, which resulted in excessively high hardness after hot forging. Thus, the cutting work could not be applied easily. In other words, application of cutting work is not preferable from viewpoint of cost.

With Experiment Example A36, [V]/[C] was low, which resulted in insufficient precipitation hardening. Thus, the rate of increase in hardness at the core part after the gas nitrocarburizing process was not sufficient.

Example 2

For Experiment Examples B1 to B10, steels having components shown in Table 5 and Table 6 were smelted. P and S in Table 6 indicate the amount of P and the amount of S detected as inevitable impurities, which are not intentionally added. The character "-" in Table 5 and Table 6 indicates that the element is intentionally not added. "Hardenability multiplying factor" in Table 6 is a value obtained from $8.65\times[C]^{1/2}\times(1+4.1\times[Mn])\times(1+0.64\times[Si])\times(1+2.33\times[Cr])\times(1+3.14\times[Mo])$ in the case of Experiment Example that contains B, and is a value obtained from $8.65\times[C]^{1/2}\times(1+4.1\times[Mn])\times(1+0.64\times[Si])\times(1+2.33\times[Cr])\times(1+3.14\times[Mo])\times(1+1.5\times(0.9-[C]))$ in the case of Experiment Example that does not contain B.

Further, "Ceq" is a value obtained from $[C]+\{[Mn]/6\}+\{([Cr]+[Mo]+[V])/5\}$.

TABLE 5

| Experiment example | C | Si | Mn | Cr | Al | V | Mo | N |
|---|---|---|---|---|---|---|---|---|
| B1 | 0.11 | 0.08 | 0.47 | 1.22 | 0.11 | 0.28 | 0.45 | 0.0058 |
| B2 | 0.14 | 0.02 | 1.25 | 0.44 | 0.06 | 0.37 | 0.50 | 0.0056 |
| B3 | 0.13 | 0.07 | 0.83 | 1.12 | 0.04 | 0.40 | 0.29 | 0.0071 |
| B4 | 0.14 | 0.03 | 1.11 | 1.10 | 0.18 | 0.56 | 0.24 | 0.0054 |
| B5 | 0.12 | 0.40 | 0.96 | 1.06 | 0.16 | 0.42 | 0.36 | 0.0072 |
| B6 | 0.10 | 0.70 | 0.60 | 2.15 | 0.05 | 0.33 | 0.29 | 0.0034 |
| B7 | 0.14 | 0.24 | 0.86 | 1.55 | 0.17 | 0.56 | 0.23 | 0.0044 |
| B8 | 0.16 | 0.08 | 0.61 | 0.77 | 0.09 | 0.10 | 0.09 | 0.0084 |
| B9 | 0.24 | 0.20 | 1.28 | 1.58 | 0.15 | 0.26 | 0.25 | 0.0092 |
| B10 | 0.16 | 0.09 | 0.76 | 1.95 | 0.03 | 0.13 | 0.85 | 0.0060 |

TABLE 6

| Experiment example | P | S | Ti | Nb | B | V/C | Ceq | Hardenability multiplying factor |
|---|---|---|---|---|---|---|---|---|
| B1 | 0.017 | 0.027 | 0.02 | — | 0.0014 | 2.55 | 0.58 | 179 |
| B2 | 0.010 | 0.017 | — | — | — | 2.64 | 0.61 | 70 |
| B3 | 0.022 | 0.030 | — | — | — | 3.08 | 0.63 | 99 |
| B4 | 0.024 | 0.018 | — | — | — | 4.00 | 0.71 | 152 |
| B5 | 0.011 | 0.026 | 0.05 | — | 0.0018 | 3.50 | 0.58 | 298 |
| B6 | 0.018 | 0.013 | — | — | — | 3.30 | 0.75 | 157 |
| B7 | 0.016 | 0.018 | — | — | — | 4.00 | 0.75 | 134 |
| B8 | 0.018 | 0.024 | — | — | — | 0.63 | 0.45 | 46 |
| B9 | 0.015 | 0.014 | 0.04 | — | — | 0.88 | 0.87 | 71 |
| B10 | 0.014 | 0.014 | 0.03 | — | 0.0007 | 0.68 | 0.87 | 260 |

For Experiment Examples B1 to B10, (1) steel strips having a thickness of 50 mm were produced from a steel smelted as described above, (2) the steel strips were subjected to a hot rolling process under a "hot rolling condition" shown in Table 7 ("heating temperature (° C.)" and "cooling rate (° C./s)") to produce a hot rolled steel plate having a thickness of 25 mm, and (3) the hot rolled steel plate was cut to produce a member having a diameter of 10 mm, (4) the member was subjected to a cold forging process to produce a cold forged member having a cylindrical shape with a thickness of 10 mm and a diameter of 14 mm, and (5) the cold forged member was cut, thereby producing a gear-shaped member.

Table 7 shows measurement results of "area percentage (%) of bainite" and "hardness (HV) after hot forging" for Experiment Examples B1 to B10.

The "area percentage (%) of bainite" represents an area percentage of bainite at a measurement position located at a depth of one-fourth the diameter measured from the surface in cross section perpendicular to the axial direction of the cold forged member. More specifically, the "area percentage (%) of bainite" was obtained by applying mirror surface finish to the measurement position, then applying an etching process to the mirror surface with a nital solution, observing five views thereof with a 500× magnification using an optical microscope, taking photographs thereof, and image analyzing the thus obtained photographs.

The "hardness after hot forging" represents hardness of the gear-shaped member before the nitriding process, and was obtained by cutting the gear-shaped member at a hardness measurement position 52 illustrated in FIG. 6 in a manner such that the central portion in the thickness direction appears, polishing, and measuring HV0.3 (2.9N) in accordance with JIS Z 2244.

TABLE 7

| | Hot rolling condition | | Area | |
|---|---|---|---|---|
| Experiment example | Heating temperature (° C.) | Cooling rate (° C./s) | percentage (%) of bainite | Hardness (HV) after hot forging |
| B1 | 1200 | 3.0 | 91 | 198 |
| B2 | 1200 | 1.0 | 100 | 190 |
| B3 | 1200 | 3.0 | 59 | 185 |
| B4 | 1200 | 0.3 | 100 | 211 |
| B5 | 1200 | 5.0 | 86 | 181 |
| B6 | 1200 | 0.3 | 59 | 186 |
| B7 | 1200 | 1.0 | 81 | 210 |
| B8 | 1050 | 10.0 | 40 | 199 |

TABLE 7-continued

| | Hot rolling condition | | Area | |
|---|---|---|---|---|
| Experiment example | Heating temperature (° C.) | Cooling rate (° C./s) | percentage (%) of bainite | Hardness (HV) after hot forging |
| B9 | 1050 | 1.0 | 96 | 322 |
| B10 | 1050 | 0.8 | 74 | 270 |

Next, a gas nitrocarburizing process was applied to the gear-shaped member described above to produce a nitrided gear. The gas nitrocarburizing process was applied under conditions of 580° C.×10 hrs in a mixture gas of $NH_3$:$N_2$:$H_2$:$CO_2$=50:40:5:5 in volume fracture. In the tests, $H_2$ gas was added in order to create an atmosphere in which generation of the white layer can be easily suppressed.

Table 8 relates to Experiment Examples B1 to B10, and shows measurement results of "surface hardness (HV)", "depth of the effective hardened case (μm)", "rate of increase in hardness at the core part after the gas nitrocarburizing process", "rotating bending fatigue strength (MPa) of test sample A", "rotating bending fatigue strength (MPa) of test sample B", "rotating bending fatigue strength (MPa) of test sample C", and "V, or Mo and V in Cr carbonitrides".

Each of the items above was measured as in Example 1.

TABLE 8

| Experiment example | Surface hardness (HV) | Depth (μm) of the effective hardened case | Rate of increase in hardness at the core part after the gas nitrocarburizing process | Rotating bending fatigue strength (MPa) of test sample A | Rotating bending fatigue strength (MPa) of test sample B | Rotating bending fatigue strength (MPa) of test sample C | V, or Mo and V in Cr carbonitrides |
|---|---|---|---|---|---|---|---|
| B1 | 796 | 351 | 1.323 | 660 | 530 | 420 | Exist |
| B2 | 704 | 325 | 1.347 | 650 | 520 | 410 | Exist |
| B3 | 751 | 366 | 1.324 | 650 | 520 | 400 | Exist |
| B4 | 943 | 336 | 1.313 | 660 | 530 | 410 | Exist |
| B5 | 885 | 311 | 1.331 | 600 | 500 | 420 | Exist |
| B6 | 653 | 335 | 1.333 | 620 | 520 | 440 | Exist |
| B7 | 969 | 320 | 1.352 | 660 | 550 | 460 | Exist |
| B8 | 678 | 264 | 1.010 | 520 | 430 | 330 | Not exist |
| B9 | — | — | — | — | — | — | Exist |
| B10 | — | — | — | — | — | — | Exist |

From Experiment Examples B1 to B7, the nitrided gear having a surface hardness of HV700 or more and a depth of the effective hardened case of 200 μm or more could be obtained. Further, the rate of increase in hardness at the core part after the nitriding process was 1.3 or more. This confirms that it is possible to achieve both workability before the nitriding process and fatigue strength.

With Experiment Example B8, the amount of V was low and the hardenability multiplying factor was low, which resulted in the area percentage of bainite being less than 50%. Further, the rate of increase in hardness at the core part after the nitriding process was low.

With Experiment Example B9, the amount of C was high, which resulted in excessively high hardness after hot rolling. Thus, the cutting work could not be applied easily. In other words, application of cutting work is not preferable from viewpoint of cost.

With Experiment Example B10, the amount of Mo was high, which resulted in excessively high hardness after hot rolling. Thus, the cutting work could not be applied easily. In other words, application of cutting work is not preferable from viewpoint of cost.

INDUSTRIAL APPLICABILITY

According to the present invention, it is possible to provide a steel for nitriding having reduced hardness before a nitriding process and capable of obtaining deepened effective hardened case and sufficient hardness at the core part through the nitriding process, and a nitrided part produced by subjecting the steel for nitriding to the nitriding process. Further, it is possible to provide a part exhibiting reduced thermal treatment distortion and enhanced fatigue strength. Thus, the present invention is applicable to parts for vehicles and various kinds of industrial machines, and has high industrial applicability.

REFERENCE SIGNS LIST

11 Cr carbonitrides
31 Cr carbonitrides containing Mo and V
51 Tooth of gear
52 Hardness measurement position after hot forging

The invention claimed is:

1. A steel for nitriding with a composition comprising, by mass %:

C: 0.10% to 0.20%;

Si: 0.01% to 0.7%;

Mn: 0.2% to 1.29%;

Cr: 0.2% to 1.3%;

Al: 0.01% to less than 0.10%;

V: over 0.2% to 1.0%;

Mo: 0% to 0.54%;

N: 0.0034 to 0.02%;

P limited to not more than 0.05%;

S limited to not more than 0.20%; and a balance including Fe and inevitable impurities, the composition satisfying Expression 1, where [V] is an amount of V by mass %, and [C] is an amount of C by mass %, wherein the steel for nitriding has a microstructure containing bainite of not less than 50% in terms of an area percentage, $$2 \leq [V]/[C] \leq 10 \quad \text{(Expression 1).}$$

2. The steel for nitriding according to claim 1, wherein

[C], [Mn], [Si], [Cr], and [Mo] satisfy Expression 2, where [C], [Mn], [Si], [Cr], and [Mo] are an amount of C, an amount of Mn, an amount of Si, an amount of Cr, and an amount of Mo, respectively, by mass %, $$65 \leq 8.65 \times [C]^{1/2} \times (1+4.1 \times [Mn]) \times (1+0.64 \times [Si]) \times (1+2.33 \times [Cr]) \times (1+3.14 \times [Mo]) \leq 400 \quad \text{(Expression 2).}$$

3. The steel for nitriding according to claim 1, wherein the composition further comprises B: 0.0003% to 0.005% by mass %, and

[C], [Mn], [Si], [Cr], and [Mo] satisfy Expression 3, where [C], [Mn], [Si], [Cr], and [Mo] are an amount of C, an amount of Mn, an amount of Si, an amount of Cr, and an amount of Mo, respectively, by mass %, $$65 \leq 8.65 \times [C]^{1/2} \times (1+4.1 \times [Mn]) \times (1+0.64 \times [Si]) \times (1+2.33 \times [Cr]) \times (1+3.14 \times [Mo]) \times (1+1.5 \times (0.9-[C])) \leq 400 \quad \text{(Expression 3).}$$

4. The steel for nitriding according to claim 1, wherein an amount of Mn is not less than 0.2% and not more than 1.0% by mass %.

5. The steel for nitriding according to claim 1, wherein an amount of Mo is not less than 0.05% and not more than 0.2% by mass %, and an amount of V is not less than 0.3% and not more than 0.6% by mass %.

6. The steel for nitriding according to claim 1, wherein

[C], [Mn], [Cr], [Mo], and [V] satisfy Expression 4, where [C], [Mn], [Cr], [Mo], and [V] are an amount of C, an amount of Mn, an amount of Cr, an amount of Mo, and an amount of V, respectively, by mass %, $$0.50 \leq [C]+\{[Mn]/6\}+\{([Cr]+[Mo]+[V])/5\} \leq 0.80 \quad \text{(Expression 4).}$$

7. The steel for nitriding according to claim 1, wherein the content of C is 0.10% to 0.19% by mass.

8. The steel for nitriding according to claim 1, wherein the content of Mn is 0.5% to 1.29% by mass.

9. The steel for nitriding according to claim 1, wherein the composition further contains at least one element of Ti and Nb, and a total amount of Ti and Nb is not less than 0.01% and not more than 0.4% by mass %.

10. The steel for nitriding according to claim 9, wherein

[C], [Mn], [Si], [Cr], and [Mo] satisfy Expression 2, where [C], [Mn], [Si], [Cr], and [Mo] are an amount of C, an amount of Mn, an amount of Si, an amount of Cr, and an amount of Mo, respectively, by mass %, $$65 \leq 8.65 \times [C]^{1/2} \times (1+4.1 \times [Mn]) \times (1+0.64 \times [Si]) \times (1+2.33 \times [Cr]) \times (1+3.14 \times [Mo]) \leq 400 \quad \text{(Expression 2).}$$

11. The steel for nitriding according to claim 9, wherein the composition further comprises B: 0.0003% to 0.005% by mass %, and

[C], [Mn], [Si], [Cr], and [Mo] satisfy Expression 3, where [C], [Mn], [Si], [Cr], and [Mo] are an amount of C, an amount of Mn, an amount of Si, an amount of Cr, and an amount of Mo, respectively, by mass %, $$65 \leq 8.65 \times [C]^{1/2} \times (1+4.1 \times [Mn]) \times (1+0.64 \times [Si]) \times (1+2.33 \times [Cr]) \times (1+3.14 \times [Mo]) \times (1+1.5 \times (0.9-[C])) \leq 400 \quad \text{(Expression 3).}$$

12. The steel for nitriding according to claim 9, wherein an amount of Mn is not less than 0.2% and not more than 1.0% by mass %.

13. The steel for nitriding according to claim 9, wherein an amount of Mo is not less than 0.05% and not more than 0.2% by mass %, and an amount of V is not less than 0.3% and not more than 0.6% by mass %.

14. The steel for nitriding according to claim 9, wherein

[C], [Mn], [Cr], [Mo], and [V] satisfy Expression 4, where [C], [Mn], [Cr], [Mo], and [V] are an amount of C, an amount of Mn, an amount of Cr, an amount of Mo, and an amount of V, respectively, by mass %, $$0.50 \leq [C]+\{[Mn]/6\}+\{([Cr]+[Mo]+[V])/5\} \leq 0.80 \quad \text{(Expression 4).}$$

* * * * *